United States Patent [19]

Slane

[11] Patent Number: 4,890,495

[45] Date of Patent: Jan. 2, 1990

[54] DEVICE FOR DETERMINING THE PUSH/PULL CAPABILITIES OF A HUMAN SUBJECT

[76] Inventor: Stephen M. Slane, 1526 Maple Ave., Verona, Pa. 15147

[21] Appl. No.: 245,712

[22] Filed: Sep. 16, 1988

[51] Int. Cl.[4] ..... A61B 5/22

[52] U.S. Cl. ..... 73/379; 272/129; 272/70

[58] Field of Search ..... 272/70, 129, 69, 132, 272/DIG. 6, 134; 128/25 R; 73/379, 381, 380

[56] References Cited

U.S. PATENT DOCUMENTS

| | | | |
|---|---|---|---|
| 2,183,465 | 12/1939 | Noor | 73/379 |
| 3,323,366 | 6/1967 | De Lorme, Jr. et al. . | |
| 3,465,592 | 9/1969 | Perrine | 73/379 |
| 3,672,219 | 6/1972 | Van Patten . | |
| 3,922,918 | 12/1975 | Farrar, Jr. . | |
| 3,988,931 | 11/1976 | Perryman . | |
| 4,050,310 | 9/1977 | Keiser . | |
| 4,104,918 | 8/1978 | Macoveanu et al. . | |
| 4,406,454 | 9/1983 | Dean . | |
| 4,452,447 | 6/1984 | Lepley et al. . | |
| 4,529,194 | 7/1985 | Haaheim . | |
| 4,530,496 | 7/1985 | Smith et al. . | |
| 4,553,746 | 11/1985 | Lee . | |
| 4,582,318 | 4/1986 | Giannelli et al. . | |
| 4,650,183 | 3/1987 | McIntyre . | |
| 4,667,513 | 5/1987 | Konno . | |
| 4,674,330 | 6/1987 | Ellis . | |

FOREIGN PATENT DOCUMENTS

| | | | |
|---|---|---|---|
| 216991 | 4/1968 | U.S.S.R. . | |
| 640745 | 1/1979 | U.S.S.R. . | |
| 869781 | 10/1981 | U.S.S.R. | 272/129 |
| 2031737 | 4/1980 | United Kingdom | 73/379 |

OTHER PUBLICATIONS

Snook, "Normative Data for Material Handling Tasks", 1978, pp. 2063–2085.

Aghazadeh et al., "A Comparison of Dynamic- and Static-Strength Models for Prediction of Lifting Capacity", 1985, pp. 1409–1417.

Winkel, "On the Manual Handling of Wide-Body Carts Used by Cabin Attendents in Civil Aircraft", 1983, 162–168.

Kroemer, "Horizontal Push and Pull Forces", 1974, pp. 94–102.

Grieve, "The Influence of Posture on Power Output Generated in Single Pulling Movements", 1984, pp. 115–117.

Hedberg et al., "Physical and Muscular Strain in Swedish Tanker Truck Drivers", 1986, pp. 817–826.

Stindberg et al., "Measurement of Force Perception in Pushing Trolleys", pp. 435–438.

LIFTASK System User's Manual, CWS Components, pp. 1–5 to 3.

American PACE Sales Brochure, 1 pg.

BALL BUSHING Sales Brochure, pp. 3–36.

Davies, "A Compendium of Isokinetics in Clinical Usage", pp. 9–17.

The CYBEX II+ Isokinetic Dynamometer Principles of Operation, pp. 7.8.23–7.8.27.

CYBEX II+ Brochure, 4 pgs.

TEF User's Manual, Chapter 2, pp. 2–1 to 2–7.

Chaffin, et al., "Volational Postures During Maximal Push/Pull Exertions in the Sagittal Plane", 1983, pp. 541–550.

*Primary Examiner*—Joseph A. Orsino
*Assistant Examiner*—Hollis T. Chen
*Attorney, Agent, or Firm*—James L. Sherman

[57] ABSTRACT

A device is for determining the functional push/pull capability of a human subject. The device includes a fixed walking surface for the subject. The push/pull bar for the subject extends horizontally and transversely of the walking surface and is disposed thereabove. The push/pull bar is mounted for selective horizontal movement along the walking surface by the subject. There is included selectively variable resistance to the horizontal movement of the push/pull bar. The device includes the ability to evaluate the horizontal movement as a function of the resistance to the horizontal movement. There is also included a method for determining the functional push/pull capability of a human subject.

16 Claims, 1 Drawing Sheet

DEVICE FOR DETERMINING THE PUSH/PULL CAPABILITIES OF A HUMAN SUBJECT

BACKGROUND OF THE INVENTION

1. Field of the Invention

This invention relates to a device for determining the push/pull capability of a human subject and, more specifically, to such a device which allows the subject to selectively move a push/pull bar mounted above the fixed walking surface.

2. Description of the Prior Art

Lower back pain is one of the most common causes of disability affecting society. Statistics indicate that in the United States, back pain is second only to the common cold as a leading cause of visits to a physician. Approximately eighty percent of people in industrial countries will experience some form of lower back pain in their life.

The annual incidents of lower back pain among industrial workers has been estimated at fifty per one thousand workers with a resulting loss of days at work which range from fourteen hundred per one thousand workers in the United States to about twenty-six hundred per one thousand workers in Great Britian. Further, research indicates that, in the United States alone, over ten million people are currently undergoing treatment for lower back pain and that one-fourth to one-half of the patients in physical therapy clinics are victims of lower back pain.

Additional statistics indicate that back pain is a self-limiting phenomenon with eighty to ninety percent of lower back pain patients tending to recover within six weeks regardless of the treatment prescribed. Within three months after a back injury, ninety-five percent of such patients will have recovered. Although it has been demonstrated that the incidents of lower back pain in non-industrial countries are similar to those in industrial countries, those in non-industrial countries do not appear to treat lower back pain as a disabling injury. In a modern society with advanced medical and legal systems, back pain has been elevated from a common ailment of unknown origin to some form of disabling injury. Further, increased reliance on injury compensation has given rise to the development of the "disability syndrome". In a recent evaluation of the Workers' Compensation Board for New York state in 1982, it has been reported that ninety-one percent of claimants represented by legal counsel were not working while seventy-seven percent of those not so represented were working. As a result, trauma to the back has grown into a broad and fertile field which lends itself to exaggeration and simulation of disability. Probably, in no other part of the body is the physician or examiner called upon so often to distinguish between real and simulated disability while having so few facts with which to make such an assessment.

Back problems clearly cost billions of dollars in treatment, compensation, lost wages and lost productivity. As a result, there is a need for a comprehensive evaluation and management program in the area of spinal disorders.

Basically, to evaluate the capability of a human subject to produce a force, three types of tests have been utilized. The three types of testing include isometric testing, isotonic testing and iso-kinetic testing. Isometric testing includes the measurement of a force produced without joint or body movement and may include, for example, the force generated while trying to lift or push an immovable object. Isotonic testing includes an evaluation of the force needed to move against a constant resistance but at a variable speed, such as with weight-lifting. Isokinetic testing includes the determination of the force generated on an object at a constant speed but with a variable resistance, such as with a water exercise dynamometer resistance. A dynamometer is a device which is well known in the testing and evaluating field. A dynamometer is a hydraulic or electro-magnetic device connected to a load cell and a computer to read force exerted during some type of activity pattern. A load cell is a pressure-sensitive device connected to a computer to record force, such as lifting, pushing or pulling, etc. The load source is quite often an integral part of a computerized dynamometer or other isometric testing device used in the prior art. Some dynamometers are primarily configured for testing rotary motion around a specific axis, such as an elbow, knee, or the like. However, other dynamometers can be configured for linear motion testing which includes motion in a specific plane, whether vertical or horizontal. Although a number of measuring and evaluating devices exist which can be utilized to help determine if a subject is able to push or pull an object under some conditions, the overall configuration and method employed are critical if the information obtained is to be pertinent and reliable for the evaluation of back problems. Although a number of such devices and methods have been proposed, they appear to include numerous disadvantages and limitations for a proper analysis of back problems.

A number of simplistic devices have been utilized to measure the horizontal pushing or pulling force exerted on a fixed wall or force plate by a subject. Clearly, such isometric testing is of limited value in the "real world" since one is seldom expected in industry to attempt to move an immovable object.

In an attempt to provide some type of testing more related to the "real world", other tests have been proposed which attempt to analyze the force required in various specific professions. For example, to analyze the back problems of cabin attendants in airplanes, a test was devised which used a strain gauge tensiometer to measure the force required to initiate motion of a standard aircraft cart. However, such force measurements still tend to be isometric. A similar test involved trolly carts which were attached to a strain gauge tensiometer to again produce the same type of isometric testing results.

In this regard, one commercially available device called "The Sled" produced by American Therapeutics, Inc. of Macon, Ga., would appear, at first analysis, to provide some "real world" means for evaluating the capability of a human subject to push or pull an object. However, "The Sled" device is a platform with handles on two sides and runners attached to the bottom. Weights are placed on the floor of the surface of the base to increase the load or force required for pushing or pulling. Although such a device may be used for rehabilitation purposes, it should be clear that it is of limited value for accurately and repeatedly testing subjects having back problems. For example, there is no means provided to insure medial or lateral stability during use. Further, the subject can actually see the amount of weight being moved. Finally, the force required to move such a device would clearly depend upon the floor surface. A wide range of coefficients of friction for carpeted or smooth surfaces would prevent the test results from being truly reliable or reproducible in other locations or for other human subjects.

One prior art design included in a report on the study and evaluation of back problems utilized a treadmill for testing. The treadmill would not be subject to different coefficients of friction like "The Sled". The test subject was directed to walk on the treadmill at a self-determined pace or speed while pushing or pulling a support bar fixedly mounted at the head of the treadmill. Measurement of the force was through the stationary support bar. However, the measurement method was derived from a variable speed and a variable resistance which were not true isotonic or isokinetic force measurements. The system appeared to measure some type of contracted or modified isometric measurements rather than either isotonic or isokinetic measurements.

Other testing systems are directed to the measurement of the pushing or pulling capability of a subject through the use of a wall mounted modified friction clutch mechanism or a dynamometer. For these systems, the test subject either holds onto a bar or handle or has a harness attached to the body. The subject then exerts a pushing or pulling force against the measuring device. With such a system, it would be possible for the subject to use body weight as the sole force producer by leaning against the handle or harness and without actually performing any pushing or pulling action. Further, such a system does not accurately provide an assessment of true push/pull strength due to the lack of proper stability. As a result, the results would not allow reasonable testing and re-testing comparisons for a complete analysis of present and future capabilities.

A number of patents have issued regarding the functional capabilities of human subjects, but these patents are usually directed to systems or devices which are not directed to the ability of the subject to push or pull an object while walking. Russian Pat. No. 640,745 and U.S. Pat. Nos. 3,988,931; 4,452,447; and 4,650,183 are directed to leg, ankle or foot joint exercising or measuring devices. U.S. Pat. No. 3,465,592 discloses an isokinetic exercise process and apparatus for evaluating the ability of the subject to rotate around various body joints.

A muscle testing apparatus of U.S. Pat. No. 3,922,918 tests the ability to lift a weight in a standing position while the exercise apparatus of U.S. Pat. No. 4,050,310 is directed to the lifting or pulling motion in a lying position. Exercising and/or evaluating apparatus when the subject is in a seated position is disclosed in U.S. Pat. Nos. 3,323,366 and 4,582,318.

U.S. Pat. No. 4,529,194 discloses an exercise machine which simulates the motion of cross-country skiing. Russian Pat. No. 216,991 discloses a device for determining the horizontal pressure exerted by a standing worker who is operating a mechanical device.

These patents are incorporated by reference as if included in their entirety herein. However, it should be recognized that the more sophisticated systems which may rely on various types of isometric, isotonic or isokinetic forces are directed to the exercise or evaluation of various joints or moving portions of the body.

Generally, it appears that none of the prior art devices discussed above include an adequate push/pull assessment device for a walking subject to properly determine the functional status, the disability assessment or the capability of the subject which would suggest whether or not the subject may return to work and, if so, under what conditions.

OBJECTS OF THE INVENTION

Accordingly, it is an object of the invention to provide a device for determining the push/pull capabilities of a human subject in a walking condition.

It is another object to provide such a device which is capable of being adjusted for the particular subject or for the particular environment in which the subject may work.

Still another object of the invention includes such a device which can provide objective, qualifiable, reproducible data regarding the subject's capabilities.

It is also an object of the invention to provide such a device which can be used to accurately determine if the subject is trying to mask or hide his true capabilities.

It is still another object of the invention to provide a method for determining the push/pull capabilities of a human subject in a standing and walking condition for a more accurate determination of when the subject could return to the workplace and in what capacity.

It is an overall object of the invention to provide a device and a method for determining the push/pull capability of a subject to assist in the determination of "malingering" and to prevent the return of an individual to work too soon or in a position that may result in re-injury by providing objective and repeatable data on the actual performance ability of the subject in situations closely related to "real life" work conditions.

SUMMARY OF THE INVENTION

These and other objects of the invention are provided in a preferred embodiment including a device for determining the functional push/pull capability of a human subject. The device includes a fixed walking surface for the subject. A push/pull bar for the subject extends horizontally and transversely of the walking surface and is disposed thereabove. The push/pull bar is mounted for selective horizontal movement along the walking surface by the subject. There is included selectively variable resistance to the horizontal movement of the push/pull bar. The device includes the ability to evaluate the horizontal movement as a function of the resistance to the horizontal movement.

Additional objects of the invention are provided by the inclusion in the device of elements for selectively setting at least one predetermined speed of the push/pull bar during the horizontal movement by the subject and for measuring the force generated by the subject on the push/pull bar at the predetermined speed.

The preferred device would include the push/pull bar being selectively positioned vertically above the walking surface to a proper height for the particular subject or to simulate a height of a cart, dolly, or the like which may be used by the subject during a normal working situation.

The preferred device would include the walking surface with a minimum length which is sufficient to allow at least three walking steps by the subject during the horizontal movement of the push/pull bar.

Finally, the various objects of the invention are provided by a preferred method of determining the functional push/pull capability of a human subject to horizontally move a push/pull bar against resistance above a walking surface.

DESCRIPTION OF THE PREFERRED EMBODIMENT

Figure 1:
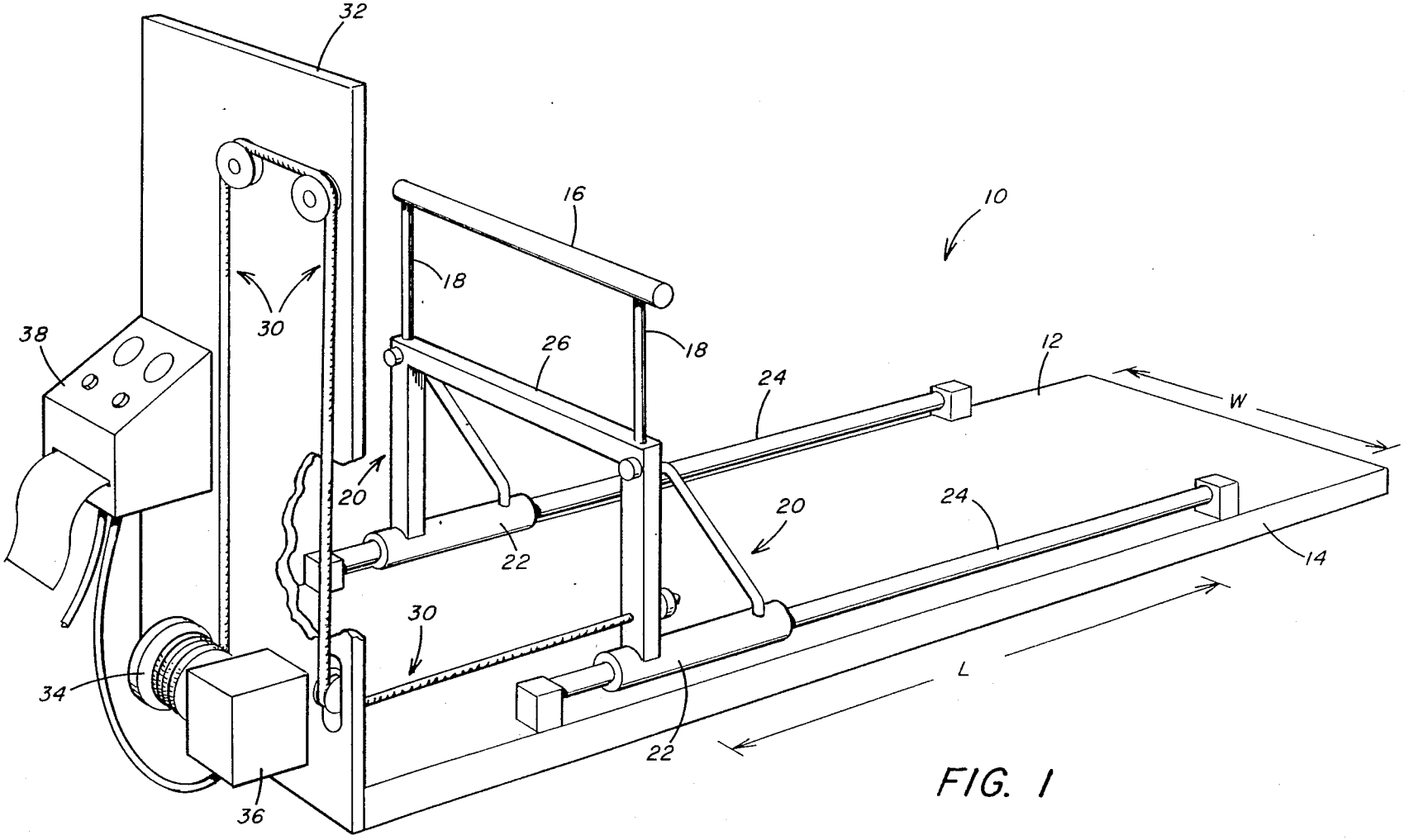
FIG. 1 is a perspective view of the preferred device for determining the push/pull capabilities of a human subject including various features of the invention.

As seen in FIG. 1, the preferred device 10 for determining the functional push/pull capabilities of a walking subject basically includes a walking surface 12 on a base or floor structure 14. Although the walking surface 12 and floor structure 14 may directly rest on the floor of the testing facility, it is possible to include wheels or the like to facilitate movement within the facility. The walking surface 12 should be sufficiently wide for the testing of most human subjects and a width W of about 28 inches is considered adequate for this purpose.

Although the overall length of the walking surface 12 may vary, the effective length L should be sufficient to allow for at least three steps to be taken by either the tallest or the shortest subject for an accurate appraisal of the ability to produce a pushing and pulling force. The effective length L is not an overall measurement of the entire walking surface 12 but specifically relates to the actual movement of the subject during testing. The effective length L having a minimum of six feet has been determined to be sufficient for most subjects. The overall minimum length of the walking surface 12 would be about ten feet to include about two feet on each side of the effective length L. The three step guide for testing subjects has been assessed as the minimum amount necessary to accurately determine control of the load in a pushing or pulling maneuver. The actual surface material for the walking surface 12 should have a non-skid characteristic to facilitate the walking movement of the subject thereon.

The preferred device 10 includes a push/pull bar 16 which extends horizontally and transversely of the walking surface 12 and is disposed above the walking surface 12. Although the specific height of the push/pull bar 16 will be discussed hereinbelow, it should be noted that the push/pull bar 16 is mounted to be selectively positioned vertically above the walking surface 12. Accordingly, the push/pull bar 16 is mounted at each end by extendible rods 18 which are slidably disposed within vertically extending support structures 20.

In order to facilitate horizontal movement of the push/pull bar 16 relative to the walking surface 12, each of the support structures 20 is mounted on a low-friction fitting 22. The low-friction fittings 22 are respectively mounted for sliding horizontal movement on steel shafts 24 which are respectively secured at opposite sides of the walking surface 12. A horizontal support 26 extending between the vertically extending support structures 20 ensures overall rigidity to the push/pull bar 16 configuration.

As basically described, the preferred configuration for mounting the push/pull bar 16 relative to the walking surface 12 is intended to control any lateral or vertical movement of the push/pull bar 16 which would interfere with an accurate determination of the horizontal force being applied thereto along the walking surface 12. The control of medial or lateral stability (in the right or left direction) allows for direct measurement of the push/pull force in a straight or linear direction. It should also be recognized that when pushing or pulling there is, in addition to the horizontal force component, a vertical force vector which tends to be in a downward direction when pushing and in an upward direction when pulling. The overall configuration for mounting the push/pull bar 16 is intended to control these unwanted motions and to allow for pure measurement of the horizontal force components.

Although the push/pull bar configuration clearly is directed to horizontal movement, it should be kept in mind that the amount of friction created during horizontal movement of the push/pull bar 16 should be kept to a minimum. Accordingly, the shafts 24 are accurately aligned to be parallel and are made of hardened steel to provide true, smooth surfaces for the movement of the low-friction fittings 22 thereon. Specifically, each low-friction fitting 22 includes Super Ball Bushing bearings by Thomson Industries, Inc. which use re-circulating ball anti-friction linear motion. As a result, the actual force required to move the push/pull bar 16 horizontally relative to the walking surface 12 is less than one pound of force.

To provide a resistance to the horizontal movement of the push/pull bar 16 by the subject, cable and pulley means 30 is secured to one of the vertically extending support structures 20 and is redirected behind a support screen 32 to the drum 34 of a dynamometer 36. As mentioned above, such dynamometers 36 are well known in the force producing and force evaluating art. It should be noted that the preferred configuration for supporting the push/pull bar 16 for horizontal movement along the walking surface 12 is so rigid and reliable that the cable and pulley configuration 30 can be simply secured to only one of the vertically extending support structures 20. In other words, even though the force is specifically directed to only one side of the push/pull bar 16, the overall configuration for supporting the push/pull bar 16 is sufficiently guided to prevent any binding or side movement which would interfere with the horizontal movement by the subject.

The preferred device 10 also includes a control unit 38 for properly controlling the dynamometer 36 and for evaluating and recording the information obtained during the testing of the subject. The specific controls and the test results obtained will be discussed in detail in the operation of the device 10 hereinbelow. It should be recognized that the control unit 38 can be operated in several modes for control of the dynamometer 36. Specifically, the dynamometer 36 can be regulated to provide specific resistance forces to the horizontal movement of the push/pull bar by the subject. The incremental addition of force enables a full evaluation of the range of capabilities of the subject. However, the use of such equipment behind the support screen 32 insures that the subject is not directly able to ascertain the amount of force being employed to resist movement of the push/pull bar or the specific changes which are used for the various tests.

The control unit 38 can also be used to regulate the speed of the dynamometer for isokinetic test purposes,. Generally, the predetermined speed of gait for such horizontal movement by the subject is based on the stride length of the subject. There are studies and formula generated which are well known in the testing art to determine typical speeds which should be employed for specific subjects. Generally, to determine the average stride length there are four separate measurements taken for each subject with the information being used in a formula to determine the speed to be used in an isokinetic test to verify the overall isotonic capabilities of the subject to move the push/pull bar 16 against various constant preset resistances.

As mentioned above, the push/pull bar 16 is vertically adjustable to a height adjustment from 25 to 60 inches to allow for infinite variations that may be found in a work situation. The particular height may be determined from examination of the work site, job analysis and additional information from studies well known in the evaluation field regarding recommended efficient heights for a subject depending upon his or her overall height.

Finally, although not specifically shown, it would be possible to include various attachments or handles to the push/pull bar to further simulate work conditions. For example, a hose or grabber bar attachment could be used to simulate work situations respectively for fire fighters or dock workers. Similarly, it would be possible to include an additional modification of handle attachments to simulate a wheelchair for hospital employees.

Having explained the overall configuration of the preferred device 10 and the overall capabilities of the various elements thereof, it is appropriate to discuss the specific tests and method used for properly evaluating the push/pull capabilities of a human subject by the use of the deyice 10.

Prior to a physician or examiner using the device 10 to evaluate a subject, an initial or intake interview is conducted with the subject to assess the level of force requirement for lifting or pushing and pulling which might occur in a work environment. Additional factors are determined such as the preferred height of a push-/pull bar to be utilized during the examination. These factors are compared with the job description for the subject and is verified by information from the employer, job analysis, or the like to insure validity of the test procedure.

With a preferred height of the push/pull bar selected and with other heights being considered for possible alternative tests, the test subject is instructed in the proper pushing and pulling position for safety and to produce the maximum effort. The subject is usually given time to practice the activity with a ten pound resistant force (a normal minimal force) for two to four repetitions.

Throughout the test procedure, the subject is monitored continuously for pulse rate during the test to assist in determining the work capability of the subject.

The isotonic test is conducted first with the test initially being at a resistance force of ten pounds. The subject must push the push/pull bar 16 (from the position as generally shown in FIG. 1) down the walking surface 12 through a distance of about six feet. The test is repeated twice to insure that the subject can control the load in a safe and reliable manner. The pulse rate is recorded after each trial and before increasing the weight. Generally, pushing tests are conducted before pulling tests with the subject being given a brief rest period between pushing and pulling tests to allow for the heart rate and blood pressure to return to normal.

As the pushing test continues, the resisting force is increased at ten pound increments. The pulse rate is recorded after each trial and the blood pressure is recorded after every fourth trial. This is done to insure that the subject does not exceed safe cardiovascular limits during the testing procedure. When the subject reaches a level that cannot be safely completed, the resisting force is reduced to the last successful level. Generally, a level is considered not successfully completed if the subject has poor control of the load during the horizontal movement down the walking surface. The test is repeated with smaller increases of five pounds resistance again until a maximum level is reached. At the conclusion of the examination, the pulse rate and blood pressure of the subject is again taken and recorded.

At the completion of such isotonic testing, the subject is directed to the other side of the walking surface 12 for pulling tests. The pulling tests are conducted in the same incremental manner until it is determined at what maximum resisting force the subject can again safely move horizontally down the walking surface 12.

The isokinetic test is preferably performed after the isotonic pulling test with the speed for the test being determined through the stride length computations discussed above which are well known in the testing art. Again, pushing is done before pulling and the subject is to perform four repetitions at each of three speeds. The speeds include the "ideal" speed which is basically determined from the stride length and additional speeds which are three inches per second slower and three inches per second faster than the "ideal" speed. Varying the speed in this manner allows for examination of interspeed as well as intraspeed consistency in order to validate the maximum effort by the subject during the isokinetic test. The isokinetic test results in a peak, torque produced at the "ideal" speed which should be within 15% of the maximum isotonic force produced. From testing previously done on the device 10, it has been found that there is the correlation of within four to eight pounds from isokinetic to isotonic test results.

Although it is of limited value, an isometric test may be conducted for further validation if necessary. The isometric test is not really preferred for proper evaluation but may be conducted to retain the results which may then be compared to previous or future isometric testing by third parties. Such isometric testing is normally performed on the device 10 in a series of five trials in each pushing and pulling direction. A coefficient of variation is computed for the trials to determine consistency during the trials. The coefficient of variation should be less than about 15% for the test to be considered a consistent valid maximal effort.

It should be kept in mind that the system can be used equally well for testing, determining progress, or for retesting applications. All the tests could be compared since a standard procedure and set-up are recorded and can be maintained to ensure consistency, reliability and validity.

It should also be noted that the device 10 could be utilized for rehabilitation or training in the specific activity of pushing or pulling with appropriate handle attachments. Further, the system could be utilized in athletic evaluation, such as football, to determine explosive power with the isokinetic dynamometer and to determine driving force with use of the isotonic force readings from the dynamometer. Again, push/pull bar modifications could be made to include push plates or the like for this purpose.

It should be clear from the description provided hereinabove that the proper use of the preferred device 10 can insure valid, reproducible and reliable information regarding the push/pull capabilities of various subjects as they walk along the walking surface 12. Further, such testing and evaluation is reliable because of the ability to use the device 10 for both isotonic and isokinetic force production which can then be compared for mutual verification to insure the validity of the test and the cooperation of the subject during the testing period. Although the device 10 can be used for isometric force measurement, it should be recognized that there is little consistency in the relationship between isotonic and isometric force production. It has been found that variations as high as 120 pounds can exist between the two so that simply measuring isometric force production is not an accurate indicator of isotonic force production.

It should also be noted that various modifications or alterations of the preferred device 10 could be made without departing from the scope of the invention as claimed. For example, while the dynamometer is commonly used successfully in the testing field to produce a resisting force for isotonic tests, a similar cable and pulley configuration could be employed used real weights.

What is claimed is:

1. A device for determining the functional push/pull capability of a human subject comprising:

a fixed walking surface for said subject;

a push/pull bar extending horizontally and transversely of said walking surface and disposed above said walking surface;

said push/pull bar being mounted for horizontal movement along said walking surface by said subject;

selectively variable means for resisting said horizontal movement of said push/pull bar; and means for evaluating said horizontal movement as a function of said means for resisting.

2. The device according to claim 1, wherein said means for resisting is selectively varied to determine a limit of said capability of said subject to produce said horizontal movement.

3. The device according to claim 2, wherein said means for resisting includes a dynamometer operably connected to said push/pull bar and said dynamometer is capable of being regulated to produce a predetermined resisting force to said horizontal movement.

4. The device according to claim 1, wherein said means for resisting includes means for selectively setting at least one predetermined speed of said push/pull bar during said horizontal movement by said subject.

5. The device according to claim 4, further including means for measuring a force on said push/pull bar by said subject during said horizontal movement at said predetermined speed.

6. The device according to claim 5, wherein said means for selectively setting includes a plurality of said predetermined speeds and said force is a function of said plurality of said predetermined speeds.

7. The device according to claim 6, wherein said means for resisting includes a dynamometer operably connected to said push/pull bar and said dynamometer is capable of being set to establish said predetermined speed and includes means for indicating said force produced by said subject during said horizontal movement.

8. The device according to claim 1, wherein said push/pull bar is selectively positioned vertically above said walking surface.

9. The device according to claim 1, wherein said walking surfaces has a minimum length which is sufficient to allow at least three walking steps by said subject during said horizontal movement.

10. The device according to claim 1, further including a pair of parallel side rails mounted at opposite sides of said walking surface, a low-friction fitting mounted on each of said side rails and a vertically extending support structure fixedly secured to said low-friction fitting to support an end of said push/pull bar.

11. The device according to claim 10, wherein said vertically extending support structures include a horizontal support structure therebetween and each of said low-friction fittings and said vertical support structures secured thereto move correspondingly on said side rails relative to said walking surface during said horizontal movement of said push/pull bar by said subject.

12. A method of determining the functional push/pull capability of a human subject comprising the steps of:

providing a walking surface for said subject;

moving a push/pull bar mounted for horizontal movement above said walking surface by said subject;

providing a resistance to said horizontal movement of said push/pull bar; and evaluating said horizontal movement of said push-/pull bar by said subject as a function of said resistance.

13. The method according to claim 12, further including the step of selectively varying said resistance.

14. The method according to claim 12, further including the additional steps of regulating at least one speed of said horizontal movement of said push/pull bar and measuring a force produced by said subject on said push/pull bar during said horizontal movement at said speed.

15. The method according to claim 14, wherein said regulating includes additional said speeds and said measuring is of corresponding said force for each said additional speed.

16. The method according to claim 15, further including a step of comparing said evaluating said horizontal movement of said push/pull bar by said subject with said measuring said force.

* * * * *